United States Patent [19]

Kurita et al.

[11] 3,976,375

[45] Aug. 24, 1976

[54] ELECTROSTATIC COPYING MACHINE

[75] Inventors: Takaji Kurita, Kawachinagano; Susumu Tanaka, Sakai, both of Japan

[73] Assignee: Minolta Camera Kabushiki Kaisha, Osaka, Japan

[22] Filed: Dec. 26, 1973

[21] Appl. No.: 427,857

[30] Foreign Application Priority Data

Dec. 30, 1972 Japan ..... 48-3805

[52] U.S. Cl. ..... 355/14; 355/16; 96/1 C

[51] Int. Cl.[2] ..... G03G 15/26

[58] Field of Search ..... 355/3 R, 3 BE, 4, 7, 355/8, 11, 14, 15, 16, 3 CH, 17; 96/1 C

[56] References Cited

UNITED STATES PATENTS

| | | | |
|---|---|---|---|
| 2,890,343 | 6/1959 | Bolton | 355/7 X |
| 3,503,677 | 3/1970 | Uchiyama | 355/7 X |
| 3,521,950 | 7/1970 | Gardner et al. | 355/3 BE |
| 3,605,534 | 9/1971 | Alman et al. | 355/8 |
| 3,661,452 | 5/1972 | Hewes et al. | 355/3 R |
| 3,724,940 | 4/1973 | Koizumi | 355/11 X |
| 3,790,273 | 2/1974 | Tanaka | 355/16 |
| 3,796,488 | 3/1974 | Tanaka et al. | 355/16 |

OTHER PUBLICATIONS

Hider et al., "An Electrographic Printer with Asynchronous Image Belt," IBM Technical Disclosure Bulletin, vol. 9, No. 11, Apr. 1967, p. 1526.

*Primary Examiner*—Richard A. Wintercorn
*Assistant Examiner*—Kenneth C. Hutchison
*Attorney, Agent, or Firm*—Wenderoth, Lind & Ponack

[57] ABSTRACT

An electrophotographic copier having an endless photoconductive belt whose circumference is an integral multiple of one dimension of each of two sizes of exposure areas corresponding to two sizes of copy paper. A set of cams for each size of copy paper operates switches to control the operation for that paper size. At the end of each exposure cycle the belt is positioned so that the next exposure is made on a different area of the belt and so that the image is not located over the seam or joint in the belt. The belt is charged at the end of every copying cycle so that the next cycle can begin with immediate exposure, and the size of the area charged is set automatically when the size of the copy is selected.

17 Claims, 15 Drawing Figures

ELECTROSTATIC COPYING MACHINE

BACKGROUND OF THE INVENTION

The present invention relates to a copying machine and, more particularly, to a transfer type electrostatic copying machine which employs a total surface exposure system for high speed copying, employing an endless belt having one outwardly facing photosensitive surface which can be repeatedly rotated for successively copying several sizes of copy-paper sheets.

In a copying machine of a similar character, an image of an original to be copied is projected onto a charged photosensitive body so as to form a charged latent image thereon corresponding to the image on the original, the latent image being developed, for example by applying toner, for transfer onto a copy-paper sheet by a suitable means so as to obtain a copy of the original image thereon.

In the conventional copying machine of the above construction, a drum type photosensitive body is widely used. This type of copying machine employs the so-called slit scanning exposure system, in which the image to be copied is formed on the photosensitive surface of the drum by slit exposure while the photosensitive drum is being rotated, as a platform for the original document or, alternatively as a light source is being moved. Although it may be possible to effect high speed copying by the above means with less time required for printing a single copy and for obtaining the first copy the system is disadvantageous in that the second and further copies require a longer period of time between copying operations because image exposure can not be made while the platform or light source is returning to its initial position. Thus, reduction of time per copy is limited, without the possibility of high speed copying.

On the other hand, in some of the conventional copying machines, a flexible endless belt having one outwardly facing photosensitive surface is used, the endless belt being suspended between two rollers with a flat photosensitive surface defining a maximum paper size to be processed provided on both the top and bottom portions of the belt so that two copies can be obtained for each rotation of the belt. The disadvantage of the conventional copying machine of the above described type is that, besides being unable to effect high speed copying, the endless belt must travel the same distance as the maximum paper size, even for copying an image of minimum paper size, and in copying a single copy sheet the photosensitive surface of the belt is subjected to extreme fatigue resulting in short life, since the belt always makes one full rotation, necessitating the repeated use of the same photosensitive surface.

In order to achieve high speed copying in a copying machine employing a photosensitive endless belt, a high speed copying machine is proposed by U.S. Pat. No. 3,661,452 in which a total surface momentary exposure system with a jointless endless belt and flash discharge tubes for illumination is employed. In reality, however, considering the fact that a photosensitive endless belt without a joint is difficult to massproduce, with consequent high cost, and in view of the fact that the only photosensitive body readily available is one in the form of a long sheet produced by the continuous coating technique, the above ideal high speed copying machine is actually impractical. Furthermore, in the above copying machine, the photosensitive endless belt must make one complete rotation in copying a single copy sheet, necessitating the repeated use of the same image forming surface, with extreme fatigue thereof and short life of the photosensitive surface. Moreover, in the above copying machine the time required for the exposure portion to pass along the surface of the endless belt is long, being limited by the dimension of the maximum paper size in comparison with the slit scanning exposure system, so that with respect to high speed copying, the above copying machine has a serious disadvantage in the time required for making a single copy and for obtaining the first copy in a continuous copying process.

From the above description, it will be seen that in order to meet the requirements for higher copying speed, a copying machine employing a jointless photosensitive endless belt for high speed copying at a rate at least equivalent to the total momentary exposure system will have to be devised, in which the high speed copying at a rate equivalent to the slit scanning exposure system is attained in copying a single copy, with similar high speeds for Letter size, Legal size and Computer size copy paper sheets, which are all widely used in the United States. Furthermore, the life of the photosensitive surface should be extended, through approximately uniform use of the entire surface-thereof.

SUMMARY OF THE INVENTION

In the copying machine according to the present invention, a photosensitive endless belt having one joint and which can be massproduced at low cost is employed with a total surface momentary exposure system, and the entire length of the photosensitive endless belt is divided into different copy paper sheet sizes and integral multiples thereof with spaces between the sheets being included so as to provide an electrostatic copying machine for meeting the requirements for higher copying speed and for copying various sizes of copy paper sheets.

Accordingly, an essential object of the present invention is to provide an electrostatic copying machine, which adopts the total surface momentary exposure system and employs a photosensitive endless belt with substantial elimination of disadvantages inherent in the conventional copying machines.

Another important object of the present invention is to provide a copying machine of the above described type having a higher copying speed, which can meet the requirements for processing copy paper sheets of various optionally selected sizes.

A further object of the present invention is to provide a copying machine which is economical in cost, employing a photosensitive endless belt with one joint, and which is easily massproduced with consequent low cost.

An essential feature of the present invention resides in that switching over from copying a single sheet to continuous copying for many sheets and also from one copy paper size to another can be easily effected by merely pushing a selecting switch for determining the number of copies and a size selecting switch electrically connected to a control unit.

Moreover, the subsequent displacement of the image forming surface on the photosensitive endless belt, especially while making a single copy, results in a uniform use of the photosensitive surface along the entire length of the endless belt and, consequently, in longer life of the photosensitive belt.

It is another feature of the copying machine according to the present invention that precharging of the photosensitive endless belt is made possible, which contributes greatly to high speed copying.

According to a preferred embodiment of the present invention, the copying machine generally comprises a transparent platform on which to place an original thereon, an endless belt with one outwardly facing surface formed into an electrophotosensitive surface and suspended by three rollers, including one roller connected to driving means, a light source positioned below the transparent platform, two fixed mirrors and a lens therebetween to direct a beam of light carrying an image of the original to a photosensitive surface formed on the endless belt, a charger for charging the photosensitive surface of the belt, a transfer corona discharger for effecting transfer and a feeding mechanism for copy paper sheets.

In the above construction of the copy machine according to the present invention, one of the most essential features resides in that the momentary exposure which is made possible only by the total surface exposure system is effectively utilized for both single copying and continuous copying. In other words, in the transfer type electrostatic copying machine of the present invention, a photosensitive body in the form of the endless belt having only one joint is employed, and yet approximately the same high speed copying is achieved as with a perfectly endless photosensitive belt without a joint in copying many copies from a single original and in making any of several copying sizes.

The copying machine according to the present invention, also makes it possible to process the copy paper sheets of the most frequently used size, i.e., Letter size in the U.S.A., at a higher speed than those of other sizes with less time required for reproducing a single copy and for obtaining the first copy. Furthermore, the image forming surface on the photosensitive endless belt is adapted to be displaced subsequently in making a single copy, for longer life of the photosensitive endless belt.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Before the description of the present invention proceeds, it is to be noted that like parts are designated by like numerals throughout the several views of the accompanying drawings.

Figure 1:
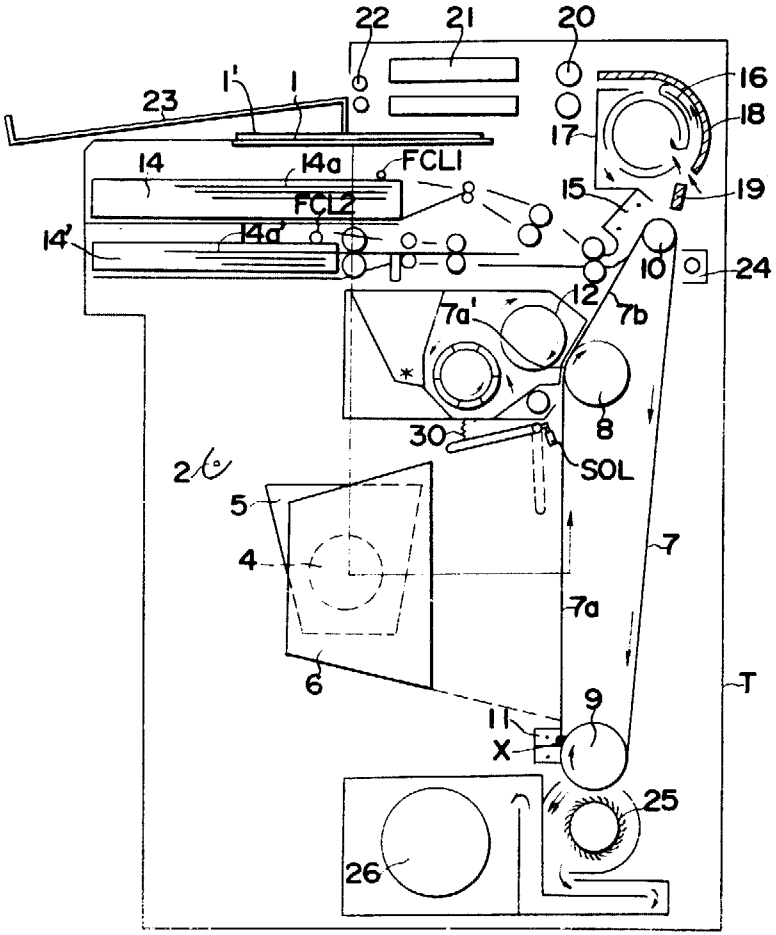
FIG. 1 is a schematic diagram showing a sectional side view of a copying machine according to the present invention, FIGS. 2(*a*) and 2(*b*) are schematic diagram of a photosensitive endless belt shown as a length of belt with divisions for Computer size four sheet copying and for Letter size six sheet copying, respectively FIGS. 3(*a*), 3(*b*) and 3(*c*) are schematic diagrams showing a cross sectional view of the electrophotosensitive endless belt.

Referring now to FIG. 1, the copying machine T of the present invention generally comprises a transparent platform 1 on which an original 1′ to be copied is placed, an endless belt 7 having one outwardly facing surface formed into an electrophotosensitive surface, an electrostatic charger 11 of a known construction and paper feeding mechanisms 14 and 14′.

The electrophotosensitive endless belt 7 is formed by joining the opposite ends of a length of belt with the joint running at right angles to a direction of travel of said endless belt, that is, at right angles to the lengthwise direction. This endless belt is suspended by three rollers 8, 9 and 10, said roller 10 being connected to suitable driving means (not shown) for driving the belt 7 in one direction as indicated by an arrow. A straight, flat photosensitive surface 7*a* formed between the rollers 8 and 9 is for electrostatical charging and has such length and width as is sufficiently large for Computer size paper. A fixed mirror 5 is provided below the transparent platform 1 at an angle of 45° to the horizontal axis of the copying machine for directing, through a lens 4, a beam of light carrying an image of the original 1′ to another fixed mirror 6 provided to reflect the beam of light onto a photosensitive surface 7*a* on the endless belt 7. In other words the fixed mirror 6 transmits the beam of light reflected by the mirror 5 and passing through the lens 4 to a vertical electrophotosensitive surface 7*a* on the endless belt 7. For this purpose, a light source 2 which may be, for example a xenon flash lamp positioned below the platform 1 and close to the mirrors 5 and 6, is provided for illuminating one surface of the original 1′ in contact with the platform 1. An electrically chargeable layer which forms an electrophotosensitive exposure surface is provided on the outwardly facing surface of the endless belt 7 in order to form an electrically charged latent image of the original 1′ thereon.

A corona charger 11 for charging the photosensitive surface of the endless belt 7 is provided adjacent to the lower end of the vertical photosensitive surface 7*a* of the endless belt 7. A light shading plate 30 for adjusting the width of the exposure surface which is provided on the upper part of the surface 7*a* is adapted to rotate by the action of a solenoid SOL between the positions shown by the real line and the dotted line and is arranged to be in the dotted line position when the entire length of the endless belt 7 is used, for Letter size six sheet copying, which will be mentioned later. A rotatable magnetic brush developer 12 for forming a toner powder image by developing an electrostatic latent image formed on the photosensitive endless belt 7 is provided close to a curved portion 7*a'* formed by the idle roller 8 on the endless belt 7. A transfer corona discharger 15 is provided close to the second photosensitive surface 7*b* formed between the idle roller 8 and the driving roller 10 at the side of the roller 10. Paper feeding mechanisms 14 and 14' for feeding copy paper sheets 14*a* and 14*a'* through several pair of conveying rollers to a transferring position between the transfer corona discharger 15 and the second photosensitive surface 7*b* adjacent the driving roller 10 are provided under the transparent platform 1.

It should be noted here that the transparent platform 1, the paper feeding mechanisms and the photosensitive surfaces 7*a* and 7*b* of the endless belt 7 are adapted to deal with copy paper sheets of both Letter size and Computer size with the transparent platform 1 marked with frames showing each size in a lengthwise direction.

The copy paper sheets 14*a* or 14*a'* fed from the paper feeding mechanism 14 or 14' through the clutches FLC1 or FLC2 and the several pairs of conveying rollers are further carried electrostatically attracted to the second photosensitive surface 7*b* of the endless belt 7 and the image formed by toner on the photosensitive surface by means of the transfer corona discharger 15 is transferred onto the copy paper sheet. Owing to the presence of a curved portion at the transferring position on the belt 7 formed by the driving roller 10, and because of the direction of advance of the copy paper sheet, the tip of the copy paper sheet is first separated from the belt 7 and then the remaining portion of the copy paper sheet is subsequently separated by the resilience of the copy paper sheet itself. The copy paper sheet is then fed onto a porous suction drum 16 provided above the tranfer corona discharger 15, guided by guide plates 18 and 19. The porous suction drum 16 is adapted to rotate at a speed equal to that of the endless belt 7 and to suck air during rotation through numerous holes provided on the surface thereof, thus attracting the copy paper sheet 14 effectively onto its outer surface, the drum is surrounded by a cover 17 and the guide plates 18 and 19. The porous suction drum 16 is electrically conductive and is suitably earthed. As the guide plates 18 and 19 are composed of insulating materials such as polyethylene or polyester, the copy paper sheet 14 charged at the discharger 15 is subjected to attraction by an opposite charge electrostatically induced on the surface of the electrically conductive porous suction drum 16, and is also held on to the outer surface of the drum 16 by the attraction resulting from the rotation of the drum 16. Since the guide plates 18 and 19 do not attract the copy paper sheet 14 and, consequently, never contact the surface of the sheet 14 (bearing an unfixed toner image), the sheet 14 is advantageously attracted to the outer surface upward without spoiling or soiling the toner image. A conveying roller 20 for feeding the copy paper sheet 14 from the drum 16 to an infrared ray fuser 21 for fixing the image is provided adjacent the drum 16. A discharge roller 22 coated with Teflon resin for discharging the copy paper sheet 14 after fixing is provided between the fuser 21 and the delivery tray 23. An electrostatic latent image eraser 24 for erasing a latent image on the photosensitive endless belt 7 is provided on the surface of belt 7 close to the driving roller 10 on the opposite side of the belt relative to the corona discharger 15. A residual toner cleaning brush 25 for removing the toner remaining on the photosensitive belt 7 is provided at the lower end of the endless belt 7 close to the idle roller 9. A suction fan 26 with a filter for removing the toner powder brushed off the belt 7 by the brush 25 is also provided adjacent the brush 25.

The transfer corona discharger 15 employed in the above copying machine according to the present invention is activated by d.c. current, giving the toner image formed on the belt 7 a charge of opposite polarity for effective transferring with strong electrostatic attraction. As the strong electrostatic attraction may hinder the separation of the copy sheet paper 14 to some extent, a transferring method employing half-wave rectification may be adopted instead of the above d.c. corona discharger 15. In the transferring method employing half-wave rectification, a half-wave rectifier with some leak resistance connected thereto is used, a half cycle with negative polarity being used for the transferring process and a half cycle with positive polarity being used for neutralizing the negative polarity, thus making it easy to separate the copy paper sheet 14 by discharging it while it is being transfered.

Figure 2:
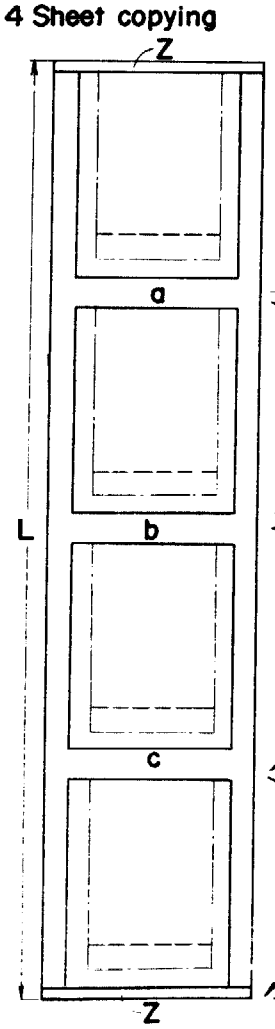
Figure 2:
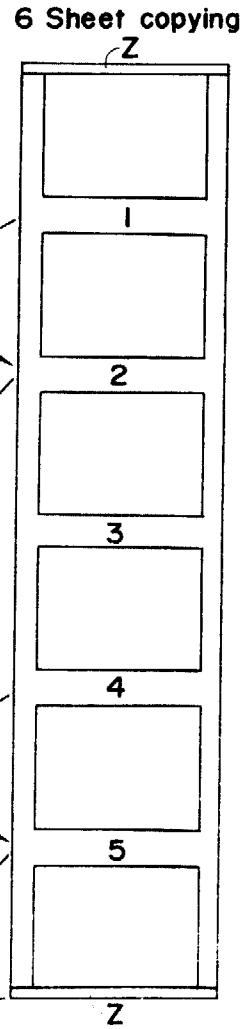

Referring now to FIG. 2, the photosensitive endless belt 7 is shown as a length of belt. In FIG. 2 (*a*) the entire length of the belt 7 is divided into four parts, while in FIG. 2 (*b*) it is divided into six parts. It is possible in the copying machine of the present invention to use four sheets or six sheets depending on the requirement. In FIG. 2 (*a*), the maximum reproduction size is of Computer size ( 11 × 14 inches ) The layout on the belt is such that four computer size copies are available from the total length of the belt 7. In addition to the length required for the four computer size sheet, the length of the joint necessary for forming the belt 7 into an endless belt and a length approximately equal to that of the above joint to provide spacing between sheets should be taken into account in determining the entire length of the belt 7. The relation can be shown in the following formula.

$$L = 4d + 4l$$

where $L$ = total length of the belt $d$ = length of maximum copying size $l$ = length of joint and intervals between sheets.

Since the maximum copying size to be obtained from the copying machine of the present invention is set to be of Computer size ( 11 × 14 inches ), several different sizes of copy can be obtained if the paper sizes are those that can be contained lengthwise in the Computer size. Frequently used copy paper sheet sizes smaller than the Computer size are Legal size ( 8.5 × 13 inches ) and Letter size ( 8.5 × 11 inches ). In FIG. 2 (*a*), the solid line outlines Computer size paper on the belt, the chain line outlines Legal size, and the dotted line indicates Letter size. As is shown in FIG. 2 (*b*) due to the fact that the width of Computer size paper is equal to the length of Letter size paper, it is possible to set letters copy paper sheets widthwise, and six Letter sizes can be taken widthwise along the entire length of the belt 7, which contributes much to the high speed copying as Letter size is most frequently used the copying operation.

Referring back to FIG. 1, upon starting the copying operation, a determination is made as to whether six sheet copying or four sheet copying is to be performed, to ensure that the joint or the space between sheets on the photosensitive endless belt 7 is located at *x* position under the charger 11. If the joint or the space between sheets on the endless belt 7 is not at the *x* position, the belt 7 is adapted to move until the nearest space between sheets comes to the *x* position. The relation between four divisions and six divisions of the entire length of belt 7 is that two sheets of four divisions can be contained in 3 sheets of six divisions and accordingly, for example, ¾ turn of the belt 7 for a single copying in four sheet divisions is equivalent to 4.5/6 turn in six sheet divisions. When the copying machine is switched over to six sheet division copying after completion of the above four sheet division copying for a single sheet, the photosensitive endless belt 7 makes 0.5/6 turn, bringing the space between sheets or the joint of the belt 7 immediately under the x position. If the joint of belt 7 or the space between sheets located at 1/2 turn of the entire length of belt 7 is at the x position when four sheet division or six sheet division copying is finished, the belt 7 is ready for six or four sheet division copying without preliminary rotation.

Preliminary rotation of the endless belt ( FIG. 3 )

a. in switching from four division copying requires initial adjustment, as follows to six division copying

| At x position | endless belt rotated to |
|---|---|
| z or b | no preliminary rotation (z or 3) |
| a or c | 2 or 5 |

b. in switching from six division copying to four division copying, the following movement is required

| | |
|---|---|
| z or 3 | no preliminary rotation (z or b) |
| 1 or 2, or 4 or 5 | a or b, or c or z |

In the four sheet division copying for producing a single copy, the copying is completed with ¾ turn of the belt 7 and in the six division copying, with 5/6 turn of the belt 7. During continuous copying, latent images are formed on each division and the belt 7 is stopped at ¾ for four division copying and at 5/6 turn for six division copying as counted from the last latent-image-formed division.

In the precharge copying system, in comparison with the above system not using precharge, the charger 11 is adapted to be operated when the image forming surface of the belt 7 passing under the charger 11 is the last image forming surface upon stopping the copying machine. By this arrangement, the image forming surface of the belt 7 located at 7*a* is kept charged, thus making it possible to obtain the first copy with a 2/4 turn of the belt 7 for four division copying and with 4/6 turn for six division copying, which function is particularly useful for high speed copying.

Referring now to (ii) of FIG. 3 and (ii) of FIGS. 3(*a*) and 3(*b*) a cross section of the photosensitive endless belt 7 according to the present invention, the photosensitive surface in FIG. 3(*a*) comprises four layers: of another from the bottom to the surface, i.e., polyester film base 101 of 100$\mu$ thickness with a thin film of aluminum 102 deposited thereon as an electrode, a thin film of noncrystalline selenium 103 less than 1$\mu$ in thickness deposited on the thin film of alumunum 102, and another painted film of organic semiconductor 104 of approximately 15 to 20 dry thickness composed of polyvinyl carbazole (PVK), polycarbonate, orthoperphenyl, paraffin chloride, and diphenyl-metandiisocyanate which is formed on the thin film 103. The photosensitive-surface in FIG. 3(*b*) is of similar construction to the above surface of FIG. 3(*a*), but has between the PVK film 104 and the Se film 103 a deposited an intermediate thin film 105 of Se-Te alloy of less than 1$\mu$ thickness in which 10 to 60% Te by weight can be mixed with Se, by which the surface of FIG. 3(*b*) has higher sensitivity than the surface of FIG. 3(*a*).

Furthermore, in FIG. 3(*a*), if a deposited film of Se-As compound is employed which is less than 1$\mu$ thick in which 5 to 50%. As by weight can be mixed with Se, instead of the selenium film 103, a photosensitive surface with improved spectro-sensitivity and heat resistance can be obtained. FIG. 3(*c*) shows the cross section of the conventional photosensitive surface comprising three layers, i.e., a flexible polyester film base with a thin film of aluminum as an electrode deposited thereon, and a film of ZnO resin dispersed photosensitive material of 10$\mu$ thickness further deposited on the above thin film of aluminum.

Figure 4:
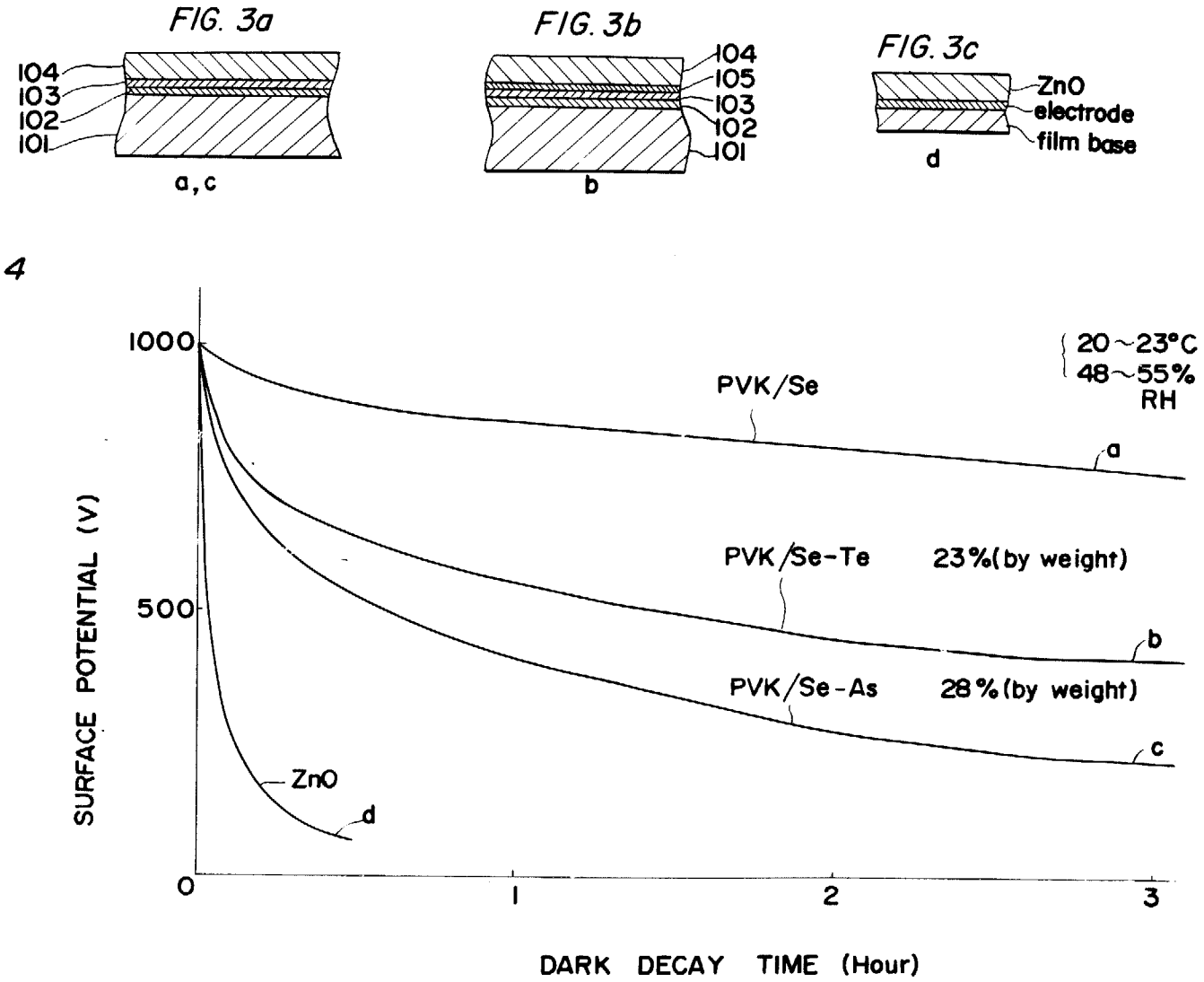
FIG. 4 is a graph showing the dark decay ratio of charge for the photosensitive surface on the endless belt.

In FIG. 4, which presents a graph showing the dark decay ratio of charge for the above mentioned photosensitive surface taken at a temperature 20°~23°C and relative humidity 48–55%, a curve (*a*) represents a case where the PVK layer is of 20$\mu$ thickness with Se film of 0.8$\mu$ thickness, a curve (*b*) indicates a situation where the PVK layer is of 20$\mu$ thickness with an alloy layer of 0.8$\mu$ thickness consisting of Se doped with 23% Te by weight, a curve (*c*) indicates a case where the PVK layer is of 20$\mu$ thickness with an alloy layer of 0.8$\mu$ thickness consisting of Se doped with 28% As by weight and a curve *d* indicates the conventional construction of a ZnO resin dispersed photosensitive surface in which ZnO layer of 10$\mu$ thickness is emplyed.

In the graph of FIG. 4, which shows the dark decay ratio when the surface potential of the photosensitive surface is 1000 volts, it will be seen that the photosensitive surface employed in the present invention can retain charge for nearly 50 minutes before the surface potential is attenuated to 450 volts, the minimum value required for image formation in an electrostatic copying machine. Although the dark decay rate may be increased to some extent due to various conditions when the above photosensitive surfaces *a*, *b* and *c* are actually installed on the copying machine, it will be seen from the graph in FIG. 4 that sufficient precharging is possible. The photosensitive surface indicated by the curve (*d*) can only be charged, in fact, up to 600 volts, but the curve is formed is values relative to 1000V for comparison.

Figure 5:
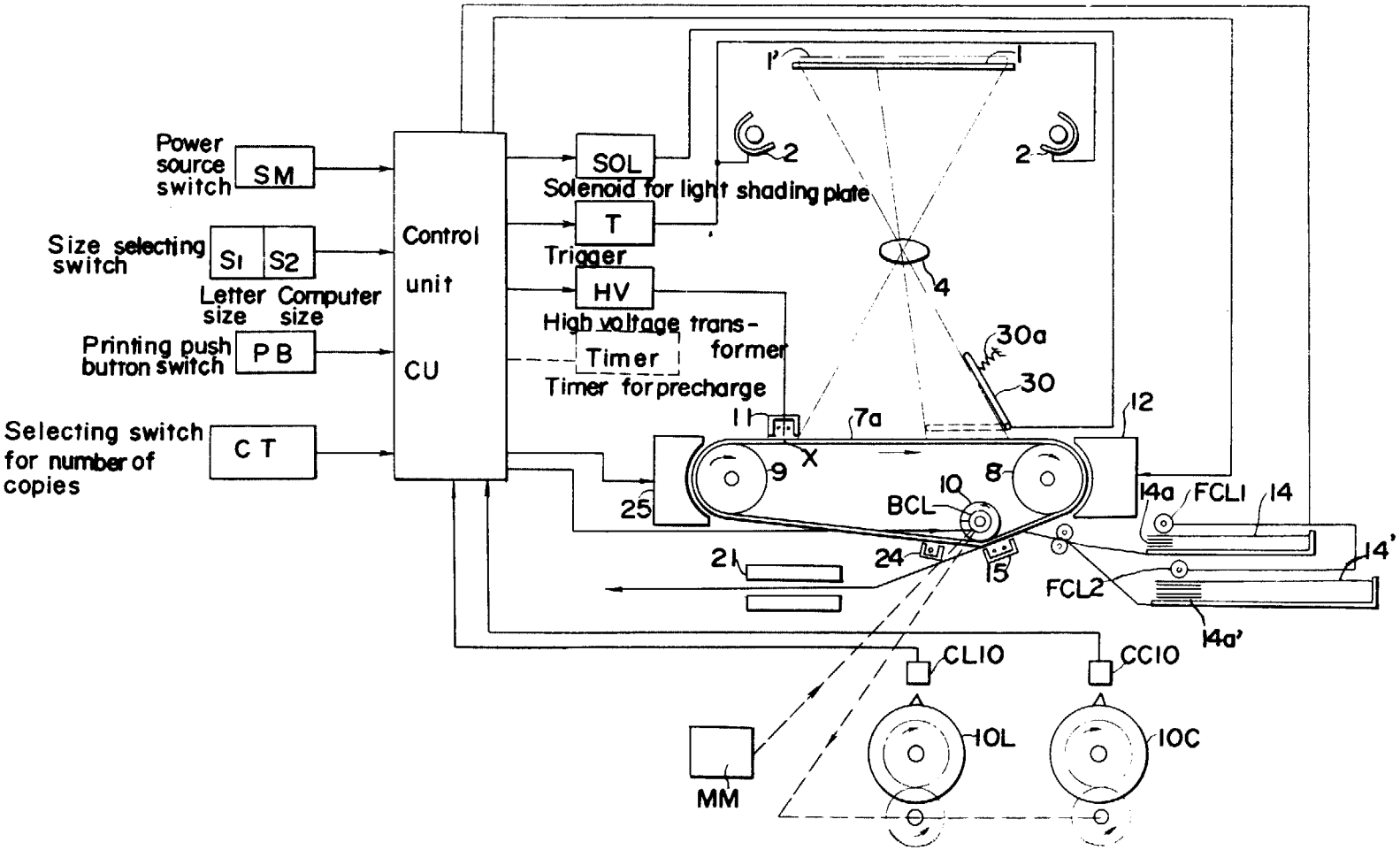
FIG. 5 is a schematic diagram showing the principle of operation for the copying machine in accordance with the present invention.

Referring now to FIG. 5, which shows the principle of operation for the copying machine according to the present invention, it is to be noted that, for facilitation of a better understanding of the present invention, like parts are designated by like reference numerals as in FIG. 1 and FIG. 2, and descriptions of similar parts are abbreviated for brevity. The copying machine of the present invention may be represented by a schematic diagram in FIG. 5, showing parts such as a transparent platform 1 on which an original 1' is positioned, a pair of xenon lamps 2 for illumination and provided adjacent to and below both ends of the above platform 1, and an endless belt 7 with one outwardly facing surface formed into a photosensitive surface. The endless belt 7 is formed by joining the opposite ends of a length of belt with the joint running perpendicular to the lengthwise direction and is suspended by three rollers 8, 9 and 10. One of the rollers 10 is connected to a drive means, to form an exposure surface 7*a* on the region where the belt is moving from left to right in the drawings. A lens 4 is provided between the transparent platform 1 and the exposure surface 7*a* for the projection of an original image onto the exposure surface 7*a*, and feeding mechanisms 14 and 14' for copy paper sheets are also provided.

The transparent platform 1 is marked with frames corresponding to different sizes of the original 1' to be copied. The endless belt 7 is adapted to turn in the direction indicated by the arrow as the rotation of a driving motor MM is transmitted to a driving roller 10 when a clutch BCL is actuated by a signal from a control unit CU. The flat exposure surface 7*a* on the endless belt 7 between the rollers 8 and 9 is adapted to be larger than Computer size paper. The charger 11 is provided over the surface of the endless belt 7 immediately before the exposure surface and adjacent the roller 9. A light shading plate 30 for optionally limiting the exposure surface 7*a* to Letter size is provided above and close to one side of the surface 7*a* and is adapted to rotate from the position shown by the solid line to the position indicated with the dotted line when a solenoid SOL is energized and to return to the original position shown by the solid line by the action of a spring 30*a* when the solenoid SOL is de-energized. The developer 12, the transfer corona discharger 15, the latent image eraser 24 and the cleaner 25 are provided along the path of travel of the endless belt 7. Paper feeding mechanisms 14 and 14' having clutches FCLI and FCL2 and several pairs of rollers, are provided so that final copies of at least two sizes, such as Computer size and Letter size, can be obtained. A power switch SM, size selecting switches $S_1$ for Letter size and $S_2$ for Computer size, a printing push button switch $P_B$ and a selecting switch CT for preselecting the number of copies to be reproduced are connected to the control unit CU, which controls the driving of the belt 7 and the operation of image forming elements. The entire length of the photosensitive endless belt 7 is arranged to be equal to the sum of four times the length of Computer size copy paper and four times the distance between copy paper sheets fed onto the endless belt 7 during continuous copying with the width of the endless belt 7 slightly longer than the length of Letter size sheet for higher speed of copying especially in continuous copying, thus enabling four Computer size and six Letter size copied sheets to be obtained during one rotation of the endless belt 7. Cams 10L for Letter size reproduction and 10C for Computer size reproduction are connected to the driving roller 10 through gears 10L' and 10C', respectively, so that the cam 10L makes six turns and the cam 10C four turns per revolution of the belt 7. The belt 7 is so arranged that the portion between electrostatic images for each of the sizes formed on the belt 7, with the joint of the belt 7 as a standard, i.e. any of regions 1, 2, 3, 4, 5 or Z for Letter size reproduction and any of regions *a*, *b*, *c*, or Z for Computer size reproduction, is located under the charger 11 immediately before the exposure surface 7*a*. The control unit CU is so arranged that in making a single copy, when the clutch BCL is actuated upon pushing the printing button $P_B$, the projection of the cam 10L actuates a switch CL10 after five turns of the cam 10L for Letter size reproduction, and the projection of the cam 10C actuates a switch CC10 after three turns of the cam 10C for Computer size reproduction. Signals from the switches CL10 or CC10 cause the clutch BCL disengage so that the belt 7 makes 5/6 turn or ⅔ turn respectively, and during continuous copying, the projection of the cam 10L or 10C actuates the switch CL10 or CC10, respectively, to stop the belt 7 at a point of rotation equivalent to a distance rotated in copying a single sheet after the belt is rotated a distance corresponding to either of two sizes, i.e., Letter size or Computer size, equivalent to the number of copies minus one.

By this arrangement, when the power switch SM is turned on, the driving motor MM starts, bringing the copying machine into a condition ready to operate. Upon pushing the Letter size switch $S_1$, the solenoid SOL is energized so that the light shading plate 30 limits the exposure surface 7*a* to Letter size. On the contrary, if the Computer size switch $S_2$ is pushed on, the solenoid SOL is de-energized and the plate 30 returns to the original position shown by the solid line by the action of the spring 30a. When the number of copies to be made is set, by operating the selecting switch CT, to be one or more than two sheets, the cams 10L and 10C are ready to be controlled by the control unit CU. Upon pushing the printing button PB on, the clutch BCL is engaged to rotate the cam 10L or 10C and the belt 7, and the charger 11 uniformly charges the belt 7 with high voltage supplied by a high voltage transformer HV for reproducing a single sheet and for reproducing a corresponding number of copies when copying more than two sheets. A trigger T is adapted to function immediately after the cams 10L or 10C complete one turn so as to light the light source flash lamp 2 and project the image of the original 1' over the charged surface 7*a* of the belt 7 to form an electrostatic latent image thereon. A timer is provided for setting an effective time for precharging, which will be mentioned later.

Figure 6:
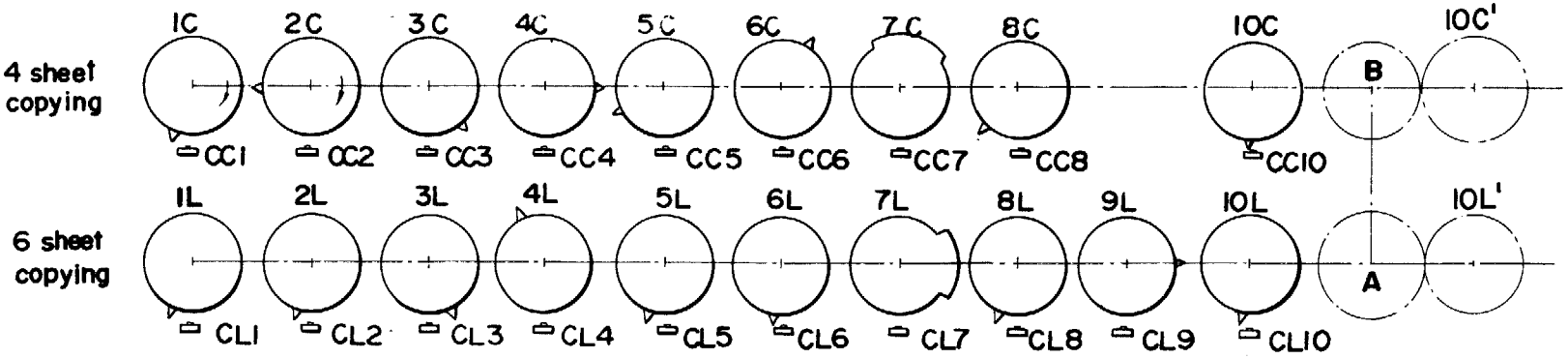
FIG. 6 is a schematic diagram showing the arrangement of the cam plates for Computer size four sheet copying and for Letter size six sheet copying.
Figure 7:
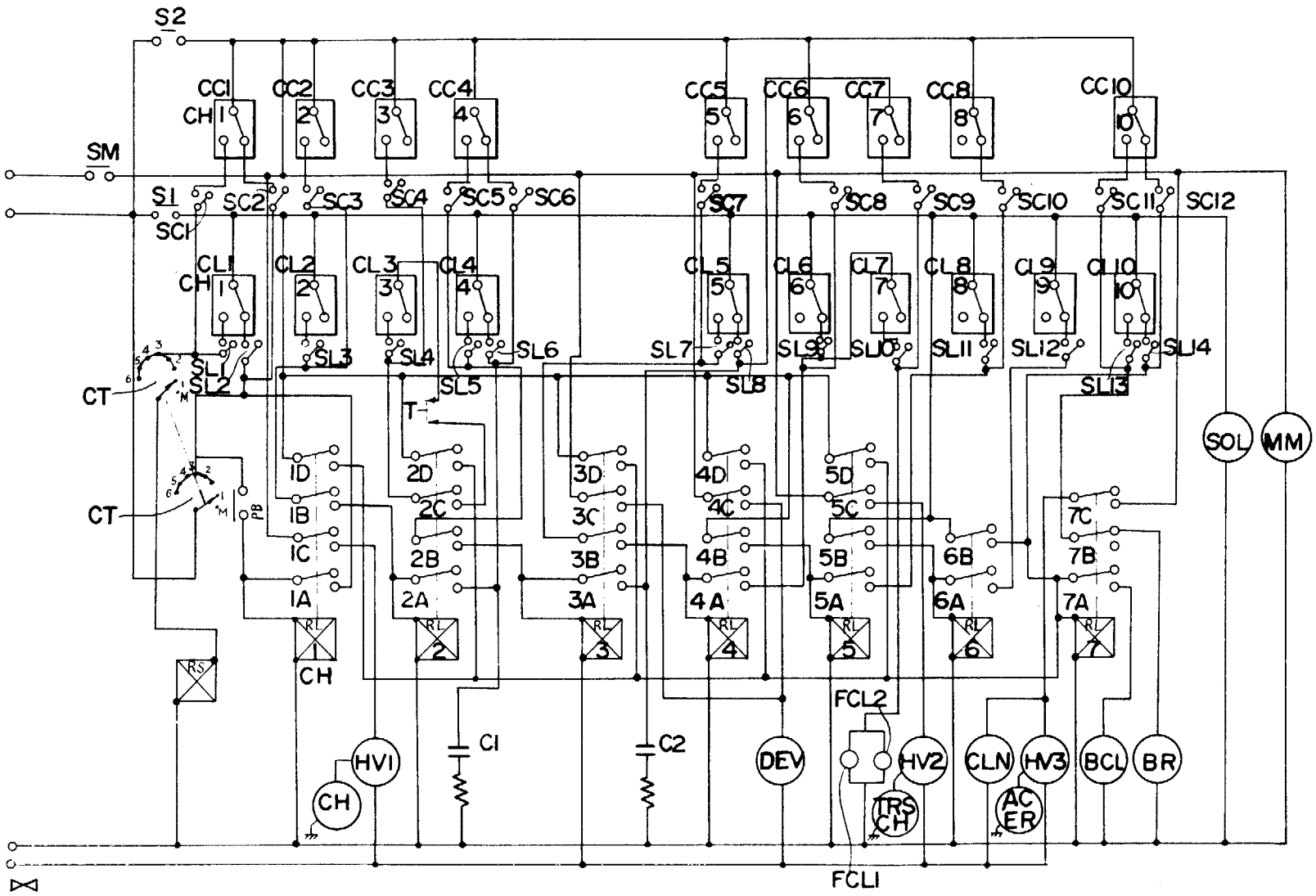
FIG. 7 is an electrical circuit diagram illustrating various elements of the copying machine according to the present invention, FIG. 8 (A) is a timing chart showing the sequence of operation for the copying machine of the present invention for Letter size six sheet copying, FIG. 8 (B) is a timing chart showing the sequence of operation for the copying machine of the present invention for Computer size four sheet copying.

Referring now to FIGS. 6 and 7, the cam 10C for Computer size sheet copying comprises nine cam plates C to 8*c* and 10*c* fixed on a shaft B and arranged in spaced relation to each other, each of the cam plates 1C to 8*c* and 10*c* having a projection for actuating a corresponding one of switches CC1 to CC8 and CC10, while the cam 10L for Letter size sheet copying has ten cam plates 1L to 10L fixedly mounted on a shaft A and in spaced relation to each other, each of the cam plates 1L to 10L having a projection for actuating a corresponding one of switches CL1 to CL10. Each of the cams 10C and 10L is adapted to rotate through reduction gears 10C' or 10L' with each of the cam plates fixed on a shaft rotating simultaneously therewith. The position of the projection on each cam plate is determined in such a way that in copying a single copy paper sheet, the belt 7 makes ¾ turn when the cam 10C makes three turns, i.e., the cam 10C makes four turns for one turn of the belt 7 for computer size sheet copying, and the belt 7 makes 5/6 turn when the cam 10L makes five turns, i.e., the cam 10L makes six turns for one turn of the belt 7.

Referring to FIG. 7, which shows a circuit diagram of the copying machine according to the present invention, the power switch SM is for turning the power source on. The size selecting switches $S_1$ and $S_2$ connected in parallel to the power switch SM are provided for selecting Computer size or Letter size reproduction by pushing on the corresponding button $S_1$ or $S_2$ while the printing push button switch PB is connected to the size selecting switches $S_1$ and $S_2$ through the selecting switch CT for choosing the number of copies to be made and also for energizing a series of relays mentioned below. The selecting switch CT is a two-step rotary switch operated by a rotary selector solenoid RS which is energized by the current from one of the switches CL1 and CC1, depending on the selected paper size, the motor MM is directly connected to the power switch SM, the solenoid SOL for the light shading plate is connected to the size selecting switch $S_1$, and each of the microswitches CL1 to CL10 for Letter size reproduction is connected in parallel to the size selecting switch $S_1$, while each of the microswitches CC1 to CC8 and CC10 is also connected in parallel to the switch $S_2$. An electromagnetic relay switch $RL_1$ comprises a relay and a plurality of contacts A, B, C and D with the relay $RL_1$ connected in series to the printing button PB, the contact A being for self-retaining, the contact B for actuating subsequent relays $RL_2$ to $RL_6$ in sequence, the contact C for actuating a plurality of processing stations arranged in the vicinity of the endless belt and the contact D for controlling the endless belt. Other relay switches $RL_2$ to $RL_7$ are constructed similarly to the relay $RL_1$. The contact 1C of the relay $RL_1$ is connected to the charger CH through a high voltage transformer $HV_1$, a contact 2C for the relay $RL_2$ is connected to a trigger T for the flash light source for illumination, contacts 3C and 4C for the relays $RL_3$ and $RL_4$ are connected to the developer DEV, a contact 5C for the relay $RL_5$ is connected to the transfer corona charger TRS CH through a high voltage transformer $HV_2$, and the relay RL7 which is connected in series to the relay RL1 operates the brake BR and the clutch BCL for the endless belt, simultaneously actuating the eraser ACER through a high voltage transformer $HV_3$ which is also operated by the relay RL7. Clutches FCL1 and FCL2 for the paper feeding mechanisms are connected in series to the size selecting switches $S_1$ and $S_2$ respectively, are adapted to switch from one paper size to another according to signals from corresponding switches $S_1$ and $S_2$. Capacitors $C_1$ and are connected to the relays $RL_2$ and $RL_3$ and are provided for time delay. The above circuit, controlled by the control unit CU in FIG. 5, generally comprises the micro switches CC1 to CC8 and CC10 for Computer size sheet copying and CL1 to CL10 for Letter size sheet copying, the microswitches being actuated by the projections of the corresponding cams 1C to 8c and 10c and 1L to 10L shown in FIG. 6, and the relay switches retained by electromagnetic relays RL1 to RL7 with the rotary solenoid selector RS, which functions in association with the two-step rotary switch CT, each relay switch having a plurality of contacts A, B, C and D as mentioned earlier. For example, if the contact 1B for the relay RL1 is closed, the relay RL2 is actuated, which, in turn, closes the contact 2B, actuating the relay RL3, with subsequent relays being actuated in this manner up to the relay RL6. Switches SC1 to SC12 are adapted to close at the same time as the size selecting switch $S_2$ for computer size paper is turned on while switches SL1 to SL14 close simultaneously with the closure of the size selecting switch $S_1$ for Letter size paper, thus setting switches CC1 to CC8 and CC10 or CL1 to CL10 ready to function. The two-step rotary switch CT for selecting the number of copies to be made is adapted to rotate from contact to contact so as to reduce the number of copies set and is driven by the pulse generated by the switch CC1 or CL1 each time the projection of the cam 10C or 10L actuates the switch CC1 or CL1.

Figure 8:
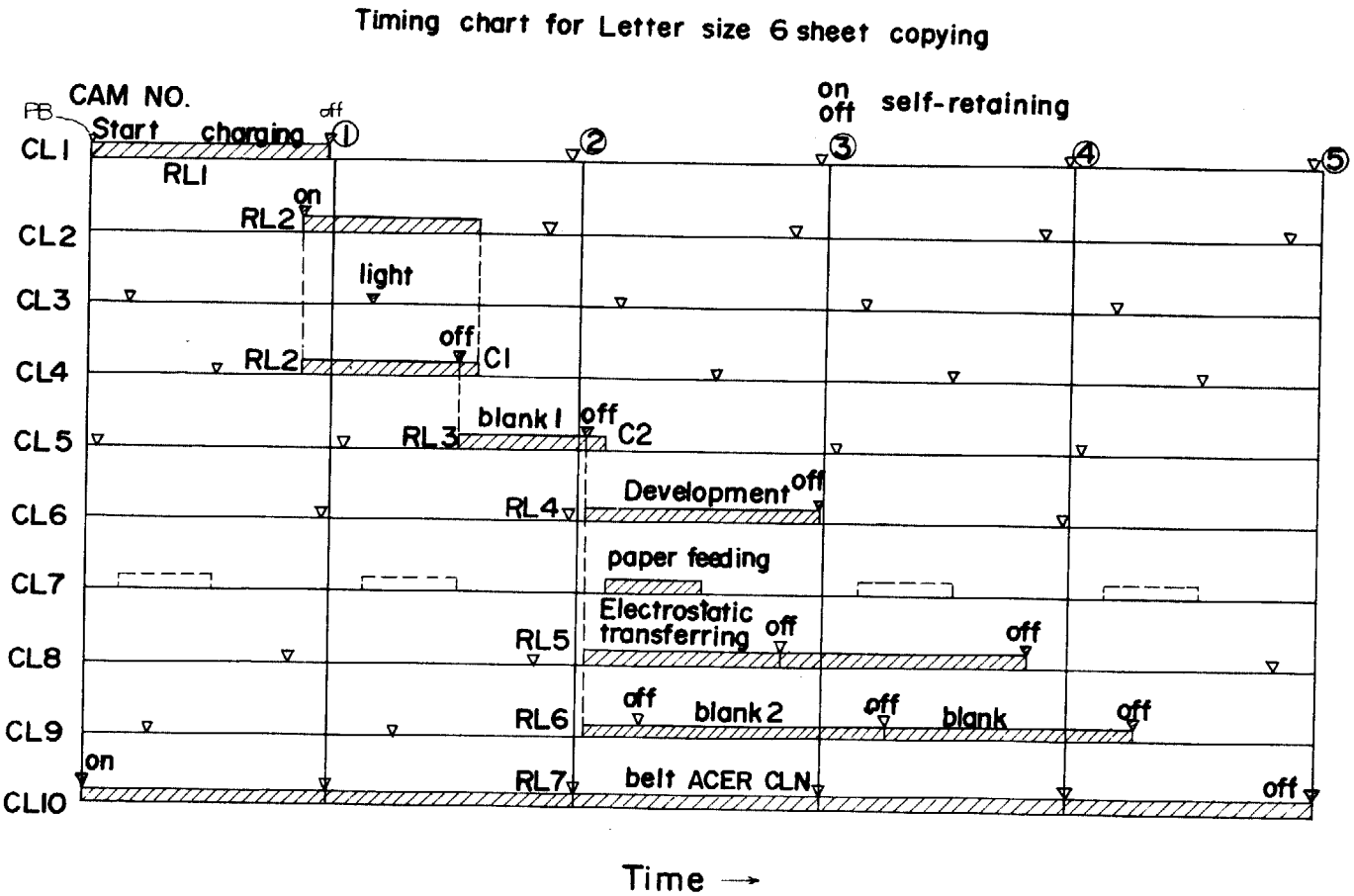
Figure 8:
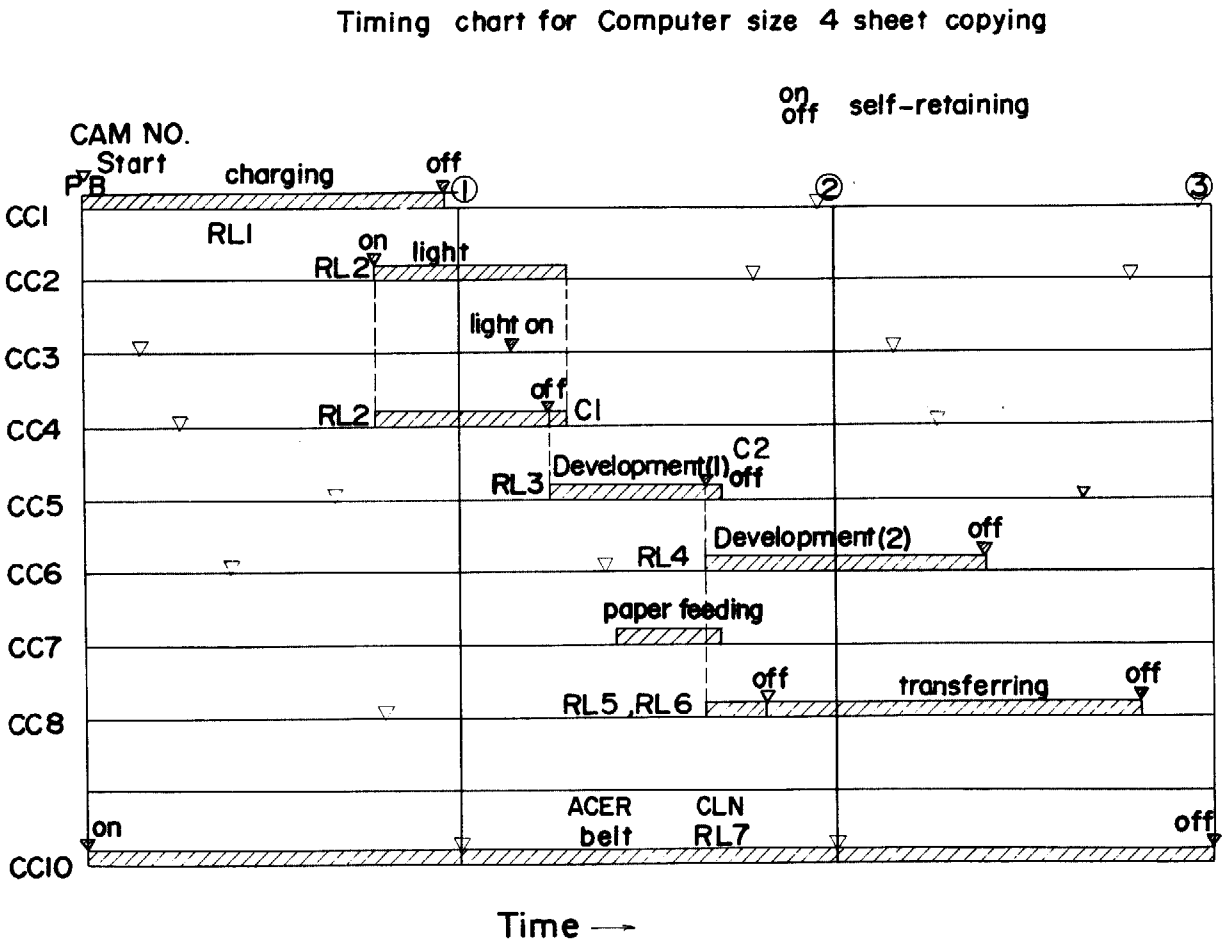

By this arrangement, for making a single copy of Letter size, when the printing switch PB is pushed on after pushing on the size selecting switch $S_1$ with the power switch SM turned on, the relay $RL_1$ is actuated with contacts 1A to 1D closed, the relay RL1 being self-retained through the contact 1A. Simultaneously, the relay RL7 connected to the contact 1D is energized with contacts 7A to 7C thereof and the switch CL10 closed. The above operation causes the charger CH to function and simultaneously the electromagnetic clutch BCL is operated so as to turn the endless belt. At this time, the electro magnetic brake BR is not working. As the cam shaft A for the cam plates 1L to 10L is connected to the driving shaft of the endless belt by means of gears and chains (not shown), the cam 10L also starts rotating when the printing switch PB is turned on, the cam 10L being adapted to make six turns for one turn of the belt. Before the cam shaft A completes one revolution the charging of a region of the photosensitive surface equivalent to 1/6 of the entire length of the endless belt is completed, the switch CL1 is turned off by the projection of the cam 1L, releasing the relay RL1 from self-retaining with contacts 1A to 1D open and the charger CH turned off. Immediately before the relay RL1 is released from self-retaining, i.e., while the contacts 1A to 1D are still on, the projection of cam 2L turns the switch CL2 on, energizing the relay RL2 with the contacts 2A to 2D closed by the current through the contact 1B and thus self-retaining the relay RL2 by the current through the switch CL4 and the contact 2A, the timing chart of which is shown in FIG. 8 (A). When the switch CL3 is turned on by the projection of the cam 3L while the relay RL2 is working, the trigger circuit T for operating the power source for the flash light for illumination is turned on, the flash light therefrom exposing the photosensitive surface for a short period of time. Soon after completion of the exposure, the switch CL4 is turned off by the projection of the cam 4L, releasing the relay RL2 from self-retaining, and thereafter the trigger T does not function when the switch CL3 is turned on. When the switch CL4 is turned off as above, the relay RL2 is adapted to remain self-retained for a short period of time by the capacitor $C_1$, thus providing a time delay, and the relay RL3 is energized by the current through the switch CL4 and the contact 2B with the contacts 3A to 3D closed. Simultaneously, the relay RL3 is self-retained by the current through the switch CL5 and the contact 3A, while the relay RL7 is kept energized by the current through the contact 3D, which is necessary for cancelling a signal for stopping the endless belt, to keep the belt rotating. When the switch CL5 is turned on by the projection of the cam 5L for controlling the starting of development, the relay RL3 is released from self-retaining after a short period of time similarly to the relay RL2 by the action of the time delay capacitor $C_2$, while the relay RL4 is energized by the current through the switch CL5 and the contact 3B and self-retained at the same time. When the switch CL4 is turned on, the copying machine developer is operated, and after the developing process has proceeded for a predetermined time, the relay RL4 is released from self-retaining by the projection of the cam 6L which actuates the switch CL6, thus stopping the developer. When the switch CL7 is actuated by the projection of the cam 7L during developing after the relay RL4 is energized, a signal for feeding a copy paper sheet is given to the clutches FCL1 or FCL2 from the switch CL7. The relays RL5 and RL6 are energized at the same time as the relay RL4 when the contacts 4B and 5B are closed, and are adapted to be released from self-retaining when the switches CL8 and CL9 are actuated by the projections of cams 8L and 9L respectively, but the relay RL5 is arranged to be kept self-retained through the contact 4B while the relay RL4 is operating, and the relay RL6 is also arranged to be kept self-retained through the contact 5B while the relay RL5 is operating, while the relay RL7 is kept energized through the contact 5D. The transfer corona charger TRS CH is controlled by the relay RL5 and while the relay RL6 is operating, the current is fed to the relay RL7 through contact 6B, cancelling the stopping signal from the switch CL10 so as to keep the endless belt rotating. When the relay RL5 is de-energized by a signal from the switch CL8, the charger TRS CH is turned off, and the relay RL7 is released from self-retaining by the projection of the cam 10L, actuating the switch CL10 after, five turns of the cam and 5/6 turn of the endless belt, thus stopping the endless belt with the clutch BCL for driving the belt disengaged. The eraser ACER and the cleaner CLN are adapted to operate while the photosensitive endless belt is rotating.

In the case of continuous copying, when the printing switch PB is pushed on after turning on the two-step rotary selecting switch CT for selecting the number of copies to be made, the relay RL1 is energized with the charger CH and the photosensitive endless belt starting operation and copying proceeds in the same manner as described above, but since the selecting switch CT is turned on, the relay RL1 is kept self-retained even when a turning off signal from the switch CL1 is fed thereto after the completion of one charging cycle, so that a series of steps from exposure by flash light source and paper feeding to developing is repeated one per revolution of the cam 10L until the number of copies set in the rotary selecting switch CT, functioning in association with the rotary solenoid RS, is reduced to zero. In other words, in copying five copy paper sheets continuously, for example, a copying operation similar to that for single sheet copying is repeated five times in succession until the rotary switch CT is turned off after copying the preset number of copies.

Referring to FIG. 8 (A) and 8 (B) showing timing charts for Letter size sheet copying and for Computer size sheet copying, the microswitches CL1 to CL10 for letter size reproduction and CC1 to CC8 and CC10 for Computer size reproduction are provided correspondingly as shown in FIG. 7 and perform similar functions according to each size selected, i.e., the switch CL1 corresponds to the switch CC1, the switch $CL_2$ to the switch $CC_2$, and so forth. Therefore, description will be made hereinbelow CL1 to CL10 using the Letter size switches for brevity.

The switch CL1 is provided for turning off the relay RL1, while the switch CL2 is used for closing the circuit by energizing the relay $RL_2$, the relay $RL_2$ and the switch CL2 being adapted to function when. The relay RL1 is energized, the CL3 is provided to turn on the trigger T for the flash ligh source when the relay RL2 is on, which means the trigger T functions when the relay RL2 and the switch CL3 are turned on Switch CL4 de-energizes the relay RL2, simultaneously energizing the relay RL3, switch CL6 de-energizes the relay R14, switch CL7 controls the clutched FCL1 and FCL2 for the paper feeding mechanisms, switch CL8 stops the transferring by de-energizing the relay RL5, switch CL9 de-energizes the relay RL6 and switch CL10 turns the relay RL7 off or on.

It should be noted here that the motor MM is turned on when the power switch SM is pushed, the position of the light shading plate being determined by the choice of size selecting switch $S_1$ or $S_2$. The clutch BCL and brake BR are operated to rotate the photosensitive endless belt when the printing switch is PB is pressed, and the brake BR, the clutch BCL, the cleaner CLN and the eraser ACER are operated when the relay RL7 is energized.

Figure 9:
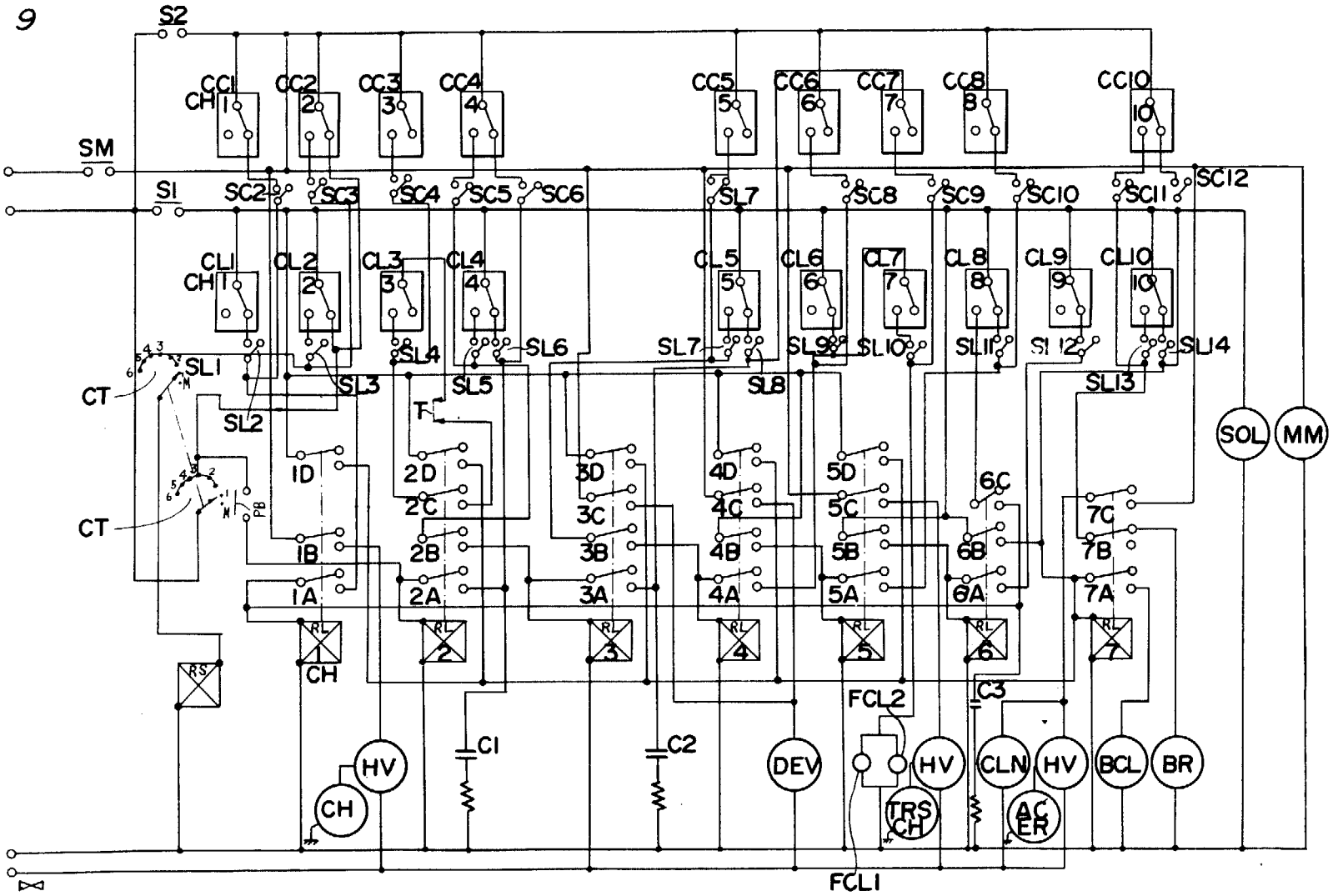
FIG. 9 is an electrical circuit diagram illustrating arrangement for various elements of the copying machine according to the present invention in the case of precharging, FIG. 10 (A) is a timing chart showing the sequence of operation in precharging the copying machine of the present invention for Letter size six sheet copying, and FIG. 10 (B) is a timing chart showing the sequence of operation in precharging the copying machine of the present invention for Computer size four sheet copying.
Figure 10:
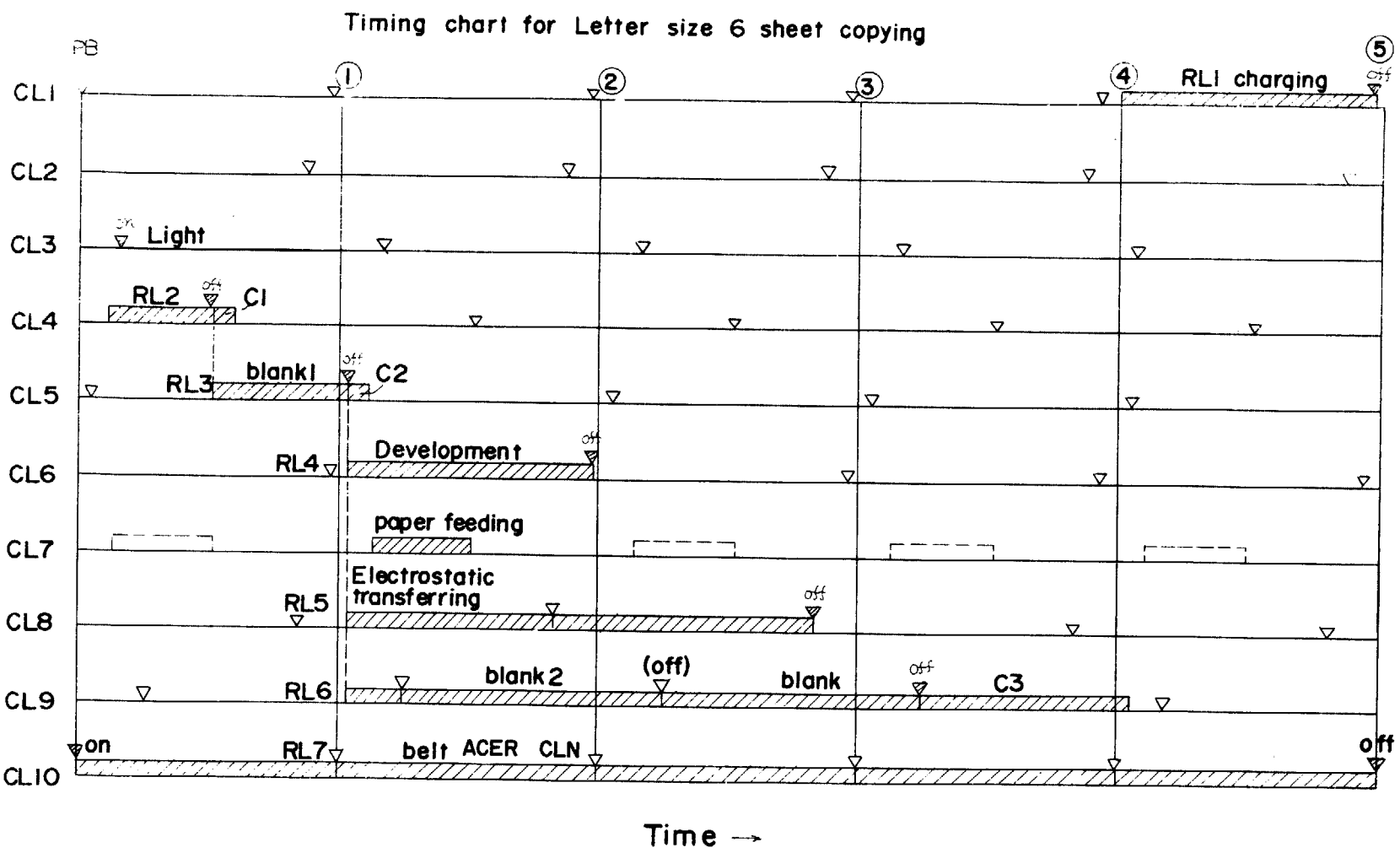
Figure 10:
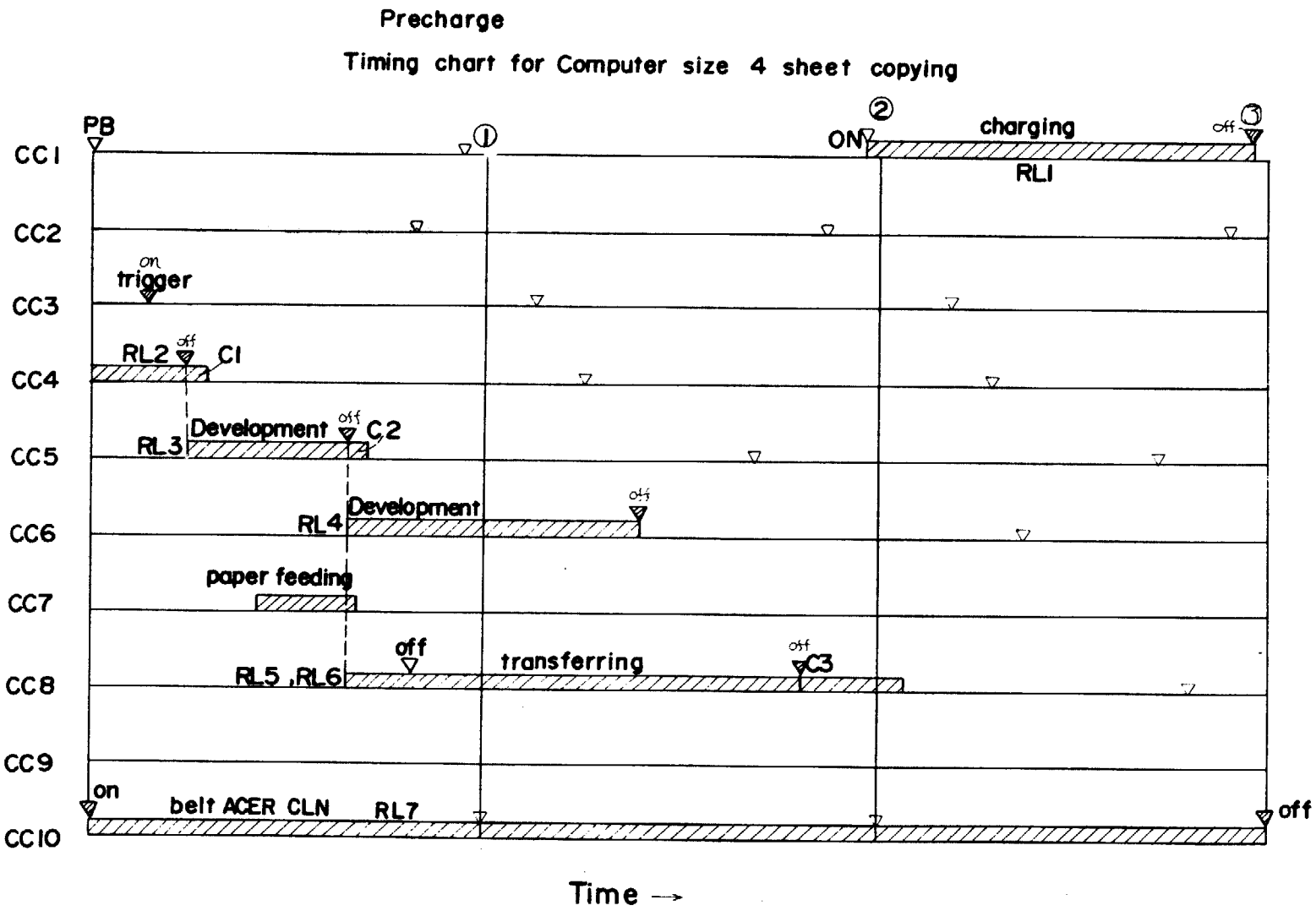

Referring now to FIGS. 9, 10 (A) and 10 (B), which depict the second embodiment according to the present invention in which precharging is adopted, it is to be noted that the circuit construction for precharging is similar to that without precharging described in the first embodiment, but that the printing push button PB is connected to the relay RL2 for precharging. The relay RL1 is connected to the contact 6C of the relay RL6. Other elements and components and functions thereof are the same as in the first embodiment without precharging, so that the description thereof is abbreviated for brevity.

By this arrangement, when the printing switch PB is pushed after the power switch SM is turned on, the relay RL2 is energized with contacts 2A to 2D closed and self-retained by the current through the contact 2A, and simultaneously the relay RL7 is energized with contacts 7A to 7C closed, engaging the clutch BCL for the endless belt and releasing the brake BR so as to turn the endless belt with the cam 10L starting to rotate at the same time. The trigger T for the flash light source is operated by the current through the contact 2C from the switch CL3, actuated by the projection of the cam 3L, and upon actuation of the switch CL4 by the projection of the cam 4L, the relay RL3 is energized by the current through the contact 2B with contacts 3A to 3D closed, and is self-retained by the current through the contact 3A. Actuation of the switch CL5 by the projection of the cam 5L energizes the relay RL4 by the current through the contact 3B with contacts 4A to 4D closed, the relay RL4 being self-retained by the current through contact 4A with the developer DEV operated by the current through contact 4C, and the development is completed upon actuation of the switch CL6 by the projection of the cam 6L.

A time chart for Computer size sheet copying is shown in FIG. 10 (B), the description thereof being abbreviated for brevity.

It should be noted here that in the precharging system, precharging is achieved by turning on the power switch SM and during the precharging time set by a timer TP, printing can be started by turning on the printing switch PB.

It is to be noted also that in the first embodiment according to the present invention, without precharging, the copying machine is adapted to effect copying after charging the photosensitive surface of the endless belt, whereas in the second embodiment, with precharging, the copying machine is adapted to operate in such a cycle that precharging of the endless belt is effected after copying.

In other words, in the first embodiment of the present invention, without precharging, the relays RL1 to RL6 are adapted to be energized in sequence in that order with relays RL1 and RL7 energized simultaneously, while in the second embodiment, with precharging, the relays are energized in the order of the relays RL2, RL3, RL4, RL5, RL6 and RL1 with relay RL2 and RL7 energized at the same time.

The precharging time is predetermined by the timer TP and when the time preset by the timer has elapsed with precharging stopped, the power switch SM can again be turned on with the timer TP reset for further precharging.

Althrough the present invention has been fully described by way of example with reference to the attached drawings, it is to be noted that various changes and modifications are apparent to those skilled in the art. Therefore, unless otherwise such changes and modifications depart from the scope of the present invention, they should be construed as included therein.

What is claimed is:

1. In an electrostatic copying machine of the type including an endless belt having an outwardly facing electrophotosensitive surface; means for supporting said endless belt for rotation about an endless path including a portion providing a flat belt surface; means for driving said belt about said endless path in a predetermined direction; corona discharge means for charging said electrophotosensitive surface of said belt and positioned upstream of said flat belt surface relative to said predetermined direction; total surface exposure means positioned adjacent said flat belt surface for exposing the total surface of an original and projecting an image thereof onto a predetermined portion of said flat belt surface after charging thereof by said corona discharge means; means positioned for feeding a transfer sheet to a location adjacent said endless belt; transfer means positioned adjacent said location for transferring said projected image from said belt surface to said transfer sheet; means for transporting said transfer sheet having said image thereon away from said endless belt; and copy operation control means for controlling the operation of said belt driving means, said corona discharge means and said total surface exposure means; the improvement wherein:

said endless belt is formed by joining opposite ends of a length of belting at a joint extending transverse to said predetermined direction;

said endless belt has a circumferential length equal to a first integral multiple greater than one of a first distance, said first distance being equal to a dimension of a first size transfer sheet plus the length of an interval between transfer sheets when said copying machine continuously operates, and said circumferential length being equal to a second integral multiple greater than one of a second distance, said second distance being different from said first distance and equal to a dimension of a second size transfer sheet plus the length of an interval between transfer sheets when said copying machine continuously operates;

transfer sheet selection means coupled to said feeding means for selectively feeding said first size transfer sheets or said second size transfer sheets to said location; and said copy operation control means comprises:

first size control means, connected to and operable by selection of said transfer sheet selection means, and connected to said belt driving means, said corona discharge means and said total surface exposure means for charging and exposing first length portions of said electrophotosensitive surface, each said first length portion being equal to said dimension of said first size transfer sheet;

second size control means, connected to and operable by selection of said transfer sheet selection means, and connected to said belt driving means, said corona discharge means and said total surface exposure means for charging and exposing second length portions of said electrophotosensitive surface, each said second length portion being equal to said dimension of said second size transfer sheet; and each said first and second size control means including positioning means, connected to and operable by said transfer sheet selection means, and connected to said belt driving means for positioning a leading edge of one of a respective said first or second length portions at a predetermined position upstream of said corona discharge means upon actuation of a copying operation.

2. The improvement claimed in claim 1, wherein said copy operation control means further comprises means connected to said belt driving means for stopping said belt, during a single copying operation of said copying machine, after a total rotation of said belt by a length equal to said circumferential length less the length of one said respective first or second length portions.

3. The improvement claimed in claim 1, wherein said copy operation control means further comprises means connected to said belt driving means for stopping said belt, during operation of said copying machine for copying a predetermined number of copies, after a total rotation of said belt by a length equal to said predetermined number times the length of the respective said first or second length portion, plus said circumferential length less said length of said respective first or second length portion.

4. The improvement claimed in claim 1, wherein said first size transfer sheet comprises Computer size paper, said first integral multiple comprises four, said second size transfer sheet comprises Letter size paper, said second integral multiple comprises six, and said endless belt has a width slightly greater than the length of said Letter size paper.

5. The improvement claimed in claim 1, further comprising means connected to and operable by said transfer sheet selection means for selectively changing the size of said predetermined portion of said flat belt surface which has said image projected thereon.

6. The improvement claimed in claim 5, wherein said changing means comprises a plate pivotally mounted for movement toward and away from said flat belt surface and respectively into and out of a portion of the path of said projected image.

7. The improvement claimed in claim 1, wherein said first and second size control means comprise respective first and second pluralities of cams connected to said belt driving means for selective rotation thereby in repsonse to selection of said transfer sheet selection means, and respective first and second pluralities of switches, connected to said corona discharge means and said total surface exposure means, and positioned to be sequentially activated by said respective cams.

8. In an electrostatic copying machine of the type including an endless belt having an outwardly facing electrophotosensitive surface; means for supporting said endless belt for rotation about an endless path including a portion providing a flat belt surface; means for driving said belt about said endless path in a predetermined direction; corona discharge means for charging said electrophotosensitive surface of said belt and positioned upstream of said flat belt surface relative to said predetermined direction; total surface exposure means positioned adjacent said flat belt surface for exposing the total surface of an original and projecting an image thereof onto a predetermined portion of said flat belt surface; means positioned for feeding a transfer sheet to a location adjacent said endless belt; transfer means positioned adjacent said location for transferring said projected image from said belt surface to said transfer sheet; means for transporting said transfer sheet having said image thereon away from said endless belt; and copy operation control means for controlling the operation of said belt driving means, said corona discharge means and said total surface exposure means; the improvement wherein:

said copy operation control means comprises means for operating said corona discharge means, said belt driving means and said total surface exposure means to provide said electrostatic copying machine with every copying operation commencing with operation of said total surface exposure means to project an image onto a predetermined portion of said flat belt surface charged in the preceding copying operation, and terminating with operation of said corona discharge means to charge a predetermined portion of said electrophotosensitive surface to be used in a subsequent copying operation, said operating means thus comprising means for precharging said subsequent copying operation predetermined portion.

9. The improvement claimed in claim 8, wherein said endless belt is formed by joining opposite ends of a length of belting at a joint extending transverse to said predetermined direction; said endless belt has a circumferential length equal to a first integral multiple greater than one of a first distance, said first distance being equal to a dimension of a first size transfer sheet plus the length of an interval between transfer sheets when said copying machine continuously operates; and said copy operation control means comprises positioning means connected to said belt driving means for positioning a leading edge of said predetermined portion such that said joint is not included therein.

10. The improvement claimed in claim 8, wherein said operating means comprises means for operating said belt driving means for stopping said belt when said precharged subsequent copying operation predetermined portion of said electrophotosensitive surface is positioned adjacent said total surface exposure means.

11. In an electrostatic copying machine of the type including an endless belt having an outwardly facing electrophotosensitive surface; means for supporting said endless belt for rotation about an endless path including a portion providing a flat belt surface; means for driving said belt about said endless path in a predetermined direction; corona discharge means for charging said electrophotosensitive surface of said belt and positioned upstream of said flat belt surface relative to said predetermined direction; total surface exposure means positioned adjacent said flat belt surface for exposing the total surface of an original and projecting an image thereof onto a predetermined portion of said flat belt surface; means positioned for feeding a transfer sheet to a location adjacent said endless belt; transfer means positioned adjacent said location for transferring said projected image from said belt surface to said transfer sheet; means for transporting said transfer sheet having said image thereon away from said endless belt; and copy operation control means for controlling the operation of said belt driving means, said corona discharge means and said total surface exposure means; the improvement wherein:

said endless belt has a circumferential length equal to a first integral multiple greater than one of a first distance, said first distance being equal to a dimension of a first size transfer sheet plus the length of an interval between transfer sheets when said copying machine continuously operates, and said circumferential length being equal to a second integral multiple greater than one of a second distance, said second distance being different from said first distance and equal to a dimension of a second size transfer sheet plus the length of an interval between transfer sheets when said copying machine continuously operates;

transfer sheet selection means is coupled to said feeding means for selectively feeding said first size transfer sheets or said second size transfer sheets to said location; and said copy operation control means comprises means, operable after the termination of every copying operation, for operating said corona discharge means to charge a predetermined portion of said electrophotosensitive surface of said belt to be used for a copy in the next subsequent copying operation before commencement of said subsequent copying operation, said operating means thus comprising means for precharging said subsequent copying operation predetermined portion; first size control means, connected to and operable by selection of said transfer sheet selection means, and connected to said belt driving means and said total surface exposure means for exposing first length portions of said electrophotosensitive surface, each said first length portion being equal to said dimension of said first size transfer sheet; and second size control means, connected to and operable by selection of said transfer sheet selection means, and connected to said belt driving means and said total surface exposure means for exposing second length portions of said electrophotosensitive surface, each said second length portion being equal to said dimension of said second size transfer sheet.

12. The improvement claimed in claim 11, wherein said copy operation control means further comprises means connected to said belt driving means for stopping said belt, during a single copying operation of said copying machine, after a total rotation of said belt by a length equal to said circumferential length less the length of twice said respective first or second length portions.

13. The improvement claimed in claim 11, wherein said copy operation control means further comprises means connected to said belt driving means for stopping said belt, during operation of said copying machine for copying a predetermined number of copies, after a total rotation of said belt by a length equal to said predetermined number times the length of the respective said first or second length portion, plus said circumferential length less twice said length of said respective first or second length portion.

14. The improvement claimed in claim 11, wherein said first size transfer sheet comprises Computer size paper, said first integral multiple comprises four, said second size transfer sheet comprises Letter size paper, said second integral multiple comprises six, and said endless belt has a width slightly greater than the length of said Letter size paper.

15. The improvement claimed in claim 11, further comprising means connected to and operable by said transfer sheet selection means for selectively changing the size of said predetermined portion of said flat belt surface which has said image projected thereon.

16. The improvement claimed in claim 15, wherein said changing means comprises a plate pivotally mounted for movement toward and away from said flat belt surface and respectively into and out of a portion of the path of said projected image.

17. The improvement claimed in claim 11, wherein said first and second size control means comprise respective first and second pluralities of cams connected to said belt driving means for selective rotation thereby in response to selection of said transfer sheet selection means, and respective first and second pluralities of switches, connected to said corona discharge means and said total surface exposure means, and positioned to be sequentially activated by said respective cams.

* * * * *